United States Patent [19]

Focke et al.

[11] Patent Number: 4,964,260

[45] Date of Patent: Oct. 23, 1990

[54] PACKAGING MACHINE FOR CARDBOARD BOXES AND PROCESS FOR PACKAGING ARTICLES IN CARDBOARD BOXES

[75] Inventors: Heinz Focke, Verden; Hugo Mutschall, Kirchlinteln, both of Fed. Rep. of Germany

[73] Assignee: Focke & Co. (GmbH & Co.), Verden, Fed. Rep. of Germany

[21] Appl. No.: 337,700

[22] Filed: Apr. 13, 1989

[30] Foreign Application Priority Data

Apr. 16, 1988 [DE] Fed. Rep. of Germany ..... 3812688

[51] Int. Cl.[5] ..... B65B 7/20; B65B 35/18; B65B 61/20

[52] U.S. Cl. ..... 53/467; 53/156; 53/157; 53/284; 53/474; 53/491; 493/102

[58] Field of Search ..... 53/129, 130, 137, 284, 53/415, 420, 485, 489, 491, 156, 157, 443, 467, 472, 474; 221/211, 262; 271/99, 102, 103, 107; 493/84, 89, 102

[56] References Cited

U.S. PATENT DOCUMENTS

| | | | |
|---|---|---|---|
| 2,200,276 | 5/1940 | Hothersall et al. | 493/102 |
| 2,299,106 | 10/1942 | Pechy | 493/102 X |
| 2,774,204 | 12/1956 | Bowman | 53/137 |
| 3,067,554 | 12/1962 | DeBack | 53/157 |
| 3,568,395 | 3/1971 | Docili | 53/474 X |
| 3,651,614 | 3/1972 | Corderoy | 53/474 X |
| 3,861,122 | 1/1975 | Boltz et al. | 53/284 X |
| 4,015,516 | 4/1977 | Graham | 493/84 |
| 4,081,945 | 4/1978 | Calvert et al. | 271/99 X |
| 4,633,655 | 1/1987 | Nigrelli, Sr. | 53/284 X |

FOREIGN PATENT DOCUMENTS 1586104 7/1970 Fed. Rep. of Germany .

*Primary Examiner*—Robert L. Spruill
*Assistant Examiner*—Linda B. Johnson
*Attorney, Agent, or Firm*—Sughrue, Mion, Zinn, Macpeak & Seas

[57] ABSTRACT

A packaging machine for cardboard boxes and a process for packaging articles in the cardboard boxes in which an insert (15) is placed into at least one side of an open cardboard shell (10). Insert units (16, 17), disposed on both sides of a moving track for the cardboard shell (10), each have an insert transmitter (19) which removes insert (15) successively from a magazine (18) and swivels the insert (15) to an upright position. The insert-transmitter (19) is moved synchronously with the packaging machine by an operating rod (22), having two double-armed levers (23, 24).

12 Claims, 5 Drawing Sheets

Figure 1:
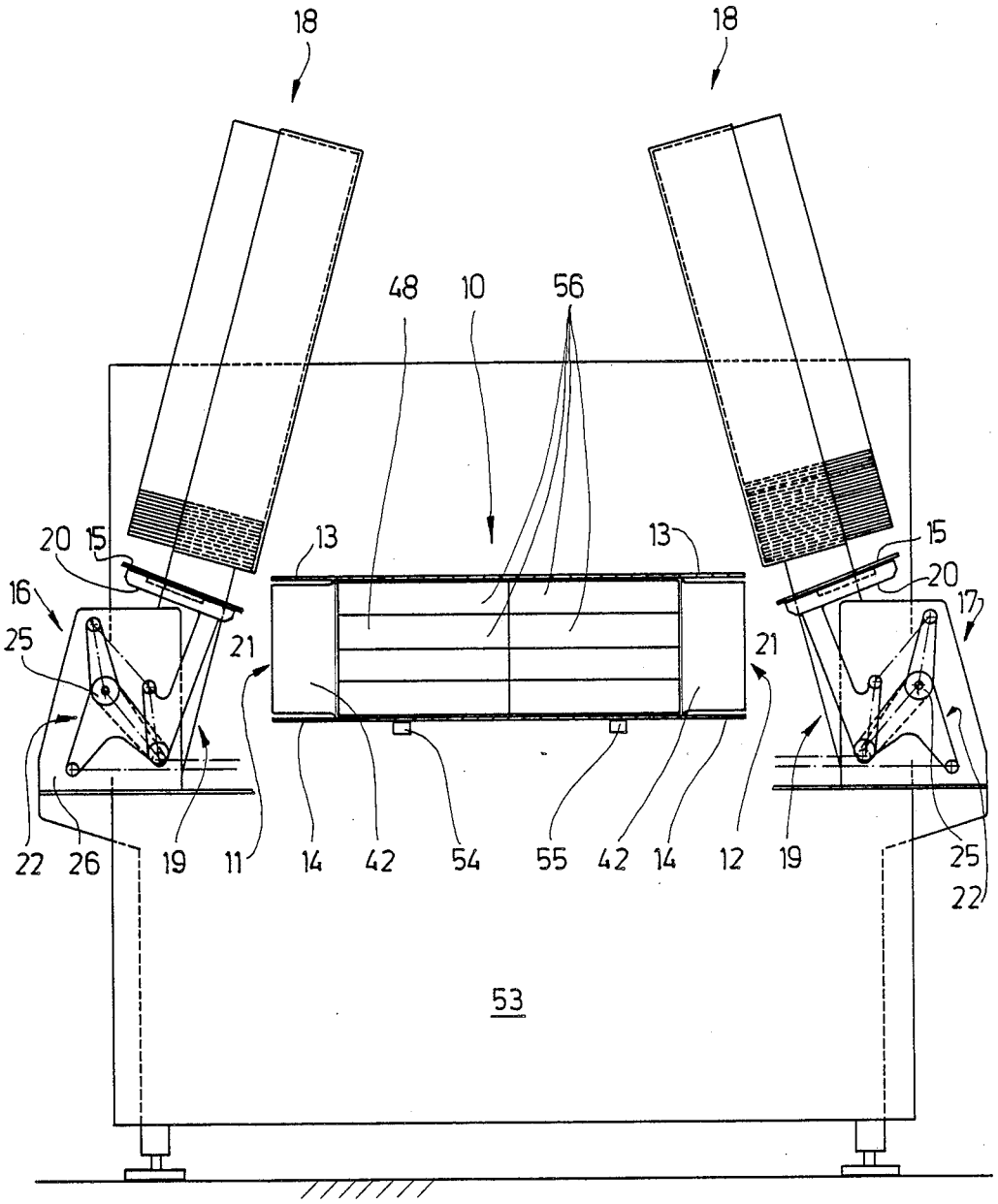

PACKAGING MACHINE FOR CARDBOARD BOXES AND PROCESS FOR PACKAGING ARTICLES IN CARDBOARD BOXES

The invention relates to a packaging machine for cardboard boxes made of a prefabricated blank, folded together flat, which is constructed to form a cardboard shell, polygonal, especially tetragonal, in cross section and open on two sides, set upright, filled and closed by folding over folding flaps, and to a process for packaging articles in cardboard boxes.

Packaging machines of the aforementioned type—cardboard packers—are employed for producing and filling large-volume packages (cardboard boxes). Conventionally, blanks having an adequately large surface area and, mostly, made of corrugated cardboard are prefabricated and already pre-folded outside of the packaging machine, to form a closed cardboard shell, in cross section. Cardboard shells, folded flat, are fed to the packaging machine.

First, the cardboard shell is set upright in the region of this machine. Then, this shell, with its open surfaces in a lateral position (top and bottom of cardboard box), is conveyed through the packaging machine, filled and closed by folding over transversely projecting folding flaps.

The invention concerns an improvement of a packaging machine for producing such cardboard boxes. The object on which the invention is based is to create integrated steps in the operating sequence of the packaging machine for the insertion of loose, separate cardboard blanks—so-called inserts—into the cardboard boxes, i.e. cardboard shells, still open, but already filled.

To achieve this object, the packaging machine according to invention is characterized in that a cardboard blank (insert) can be inserted into at least one side of the open cardboard shell. Said insert can be removed from a magazine by an insert transmitter and can be introduced into the cardboard shell in an upright position.

During the transport through the packaging machine the cardboard boxes, i.e. cardboard shells, are in a standstill phase for a short time. The apparatus according to invention for inserting the inserts is disposed in this region.

Preferably, an insert-transmitter with a magazine is disposed on both sides, respectively, of the conveying track for the cardboard shells. The inserts are taken from this magazine successively from below by the insert-transmitter, are swung into an upright position and are introduced into the cardboard shells by means of movement transversal to the conveying direction of these shells. Then the cardboard boxes are closed in the usual way by means of folding the folding flaps.

In accordance with the invention, the insert-transmitter is composed of a plate-shaped insert-holder provided with suction bores for the detachable fixing of an insert. The insert-holder, in turn, rests on a supporting arm which is movable by means of a mechanical rod. The sequence of movement is such that from a magazine,disposed at an upright angle, i.e. an acute angle, above the conveying track for the cardboard shells, one insert, respectively, is removed, moved upwards, brought to an upright position and then conveyed transversely into the open cardboard shell.

According to invention, the operating rod is composed of two levers, especially double levers, which are pivot-connected around a common point of rotation (central pivot) and hinge-connected to the insert-transmitter. As a result of meaningful relative movement of the double levers towards one another, the sequence of movement of the insert-transmitter, as described above, is guaranteed within short periods.

Further features of the packaging machine according to invention concern the arrangement and configuration of the insert-transmitter and the operating rod.

According to the process according to invention the insert is inserted in an open side of the cardboard box by the insert-transmitter and then the folding flaps are folded in the plane of the open side.

A further feature of the process according to invention consists in that after the insert is introduced into the cardboard box, it is held there, and then first, a pair of inner (short) folding flaps, and then the outer folding flaps, are folded in the plane of the open side, while simultaneously, the insert-transmitter is detached and removed from the insert. This is especially advantageous, because as a result, the position of the insert in the cardboard box can no longer be unintentionally changed, e.g. through displacement, through the process of folding the folding flaps.

Figure 2:
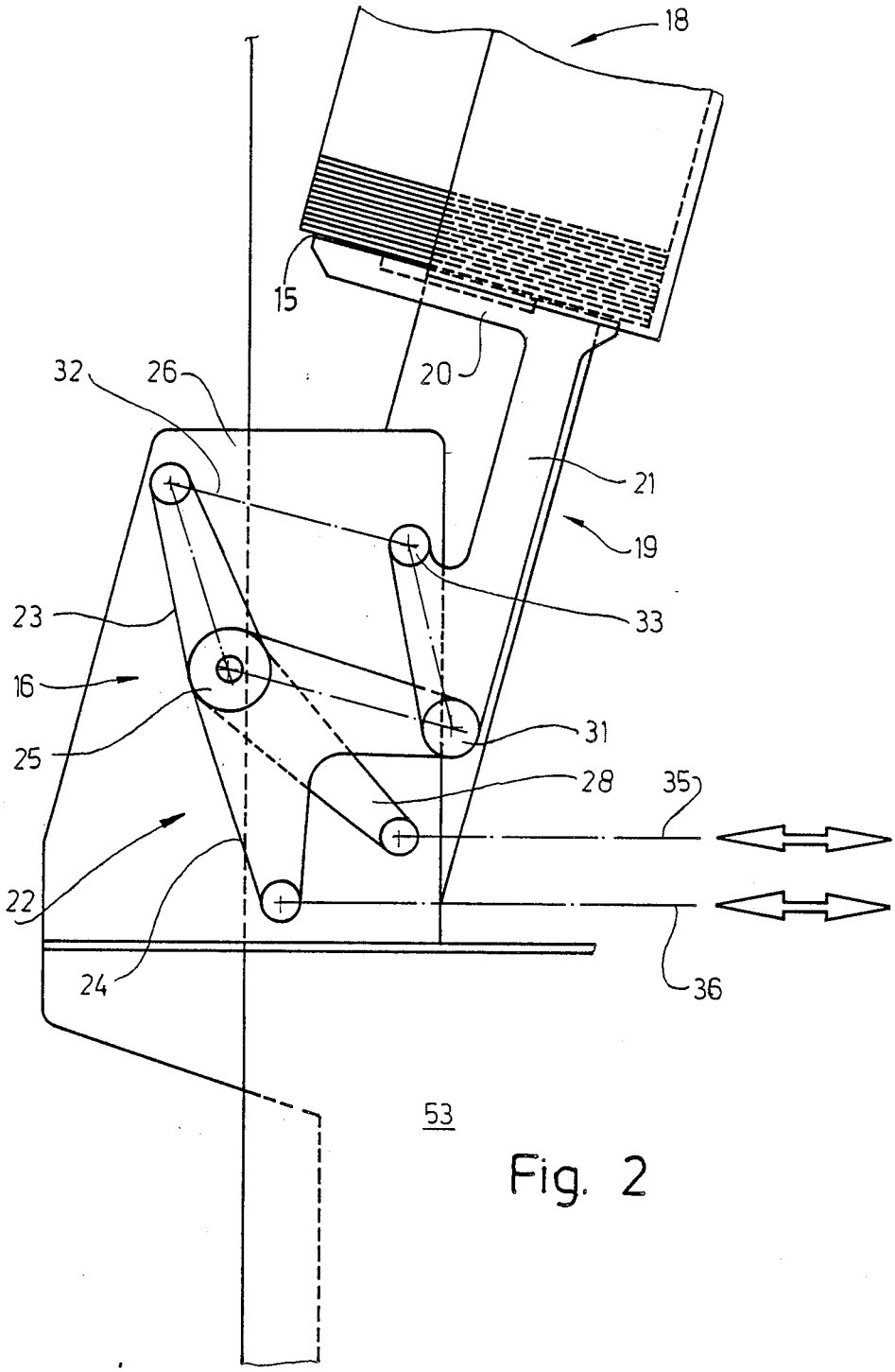
Figure 3:
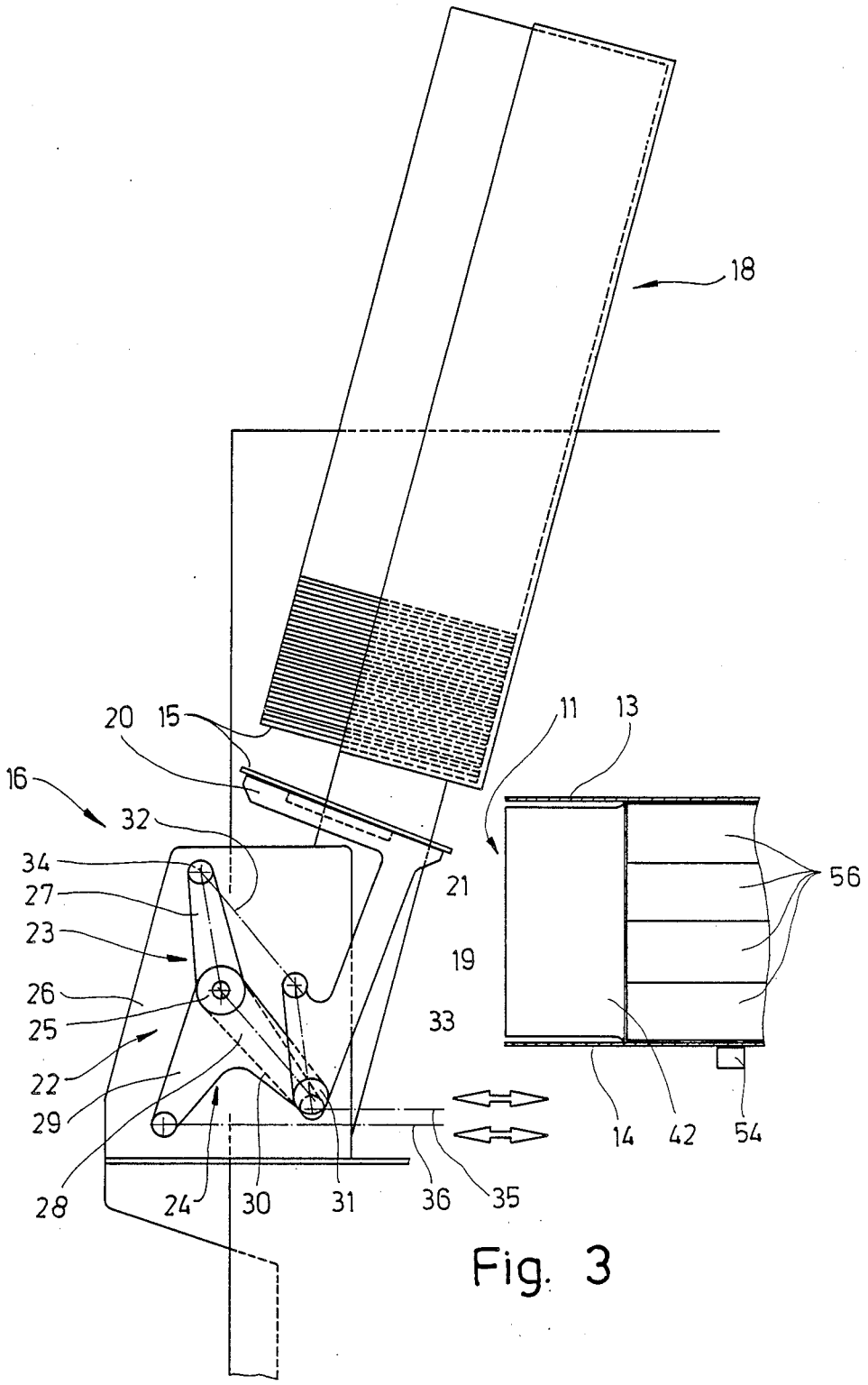
Figure 4:
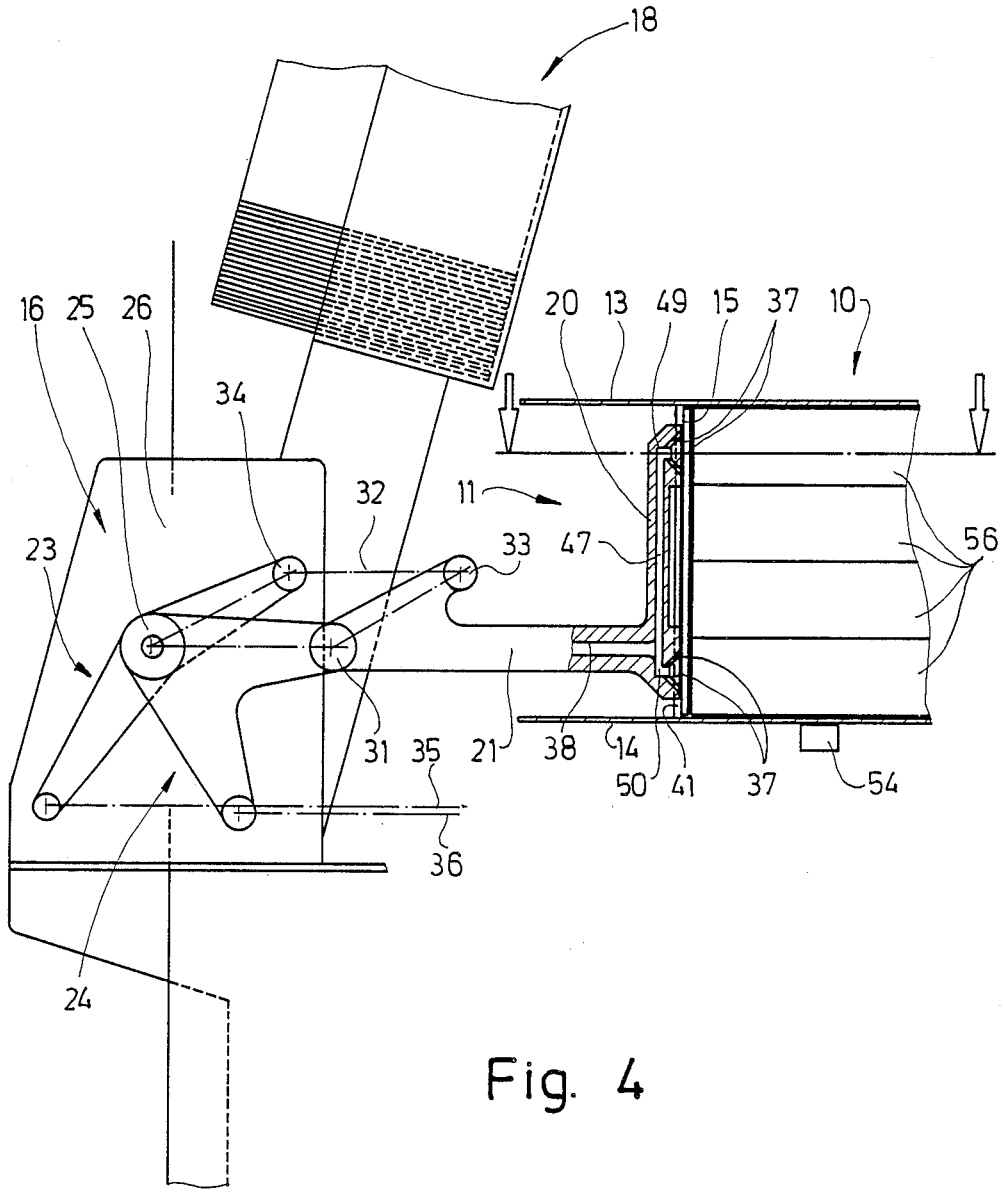
Figure 5:
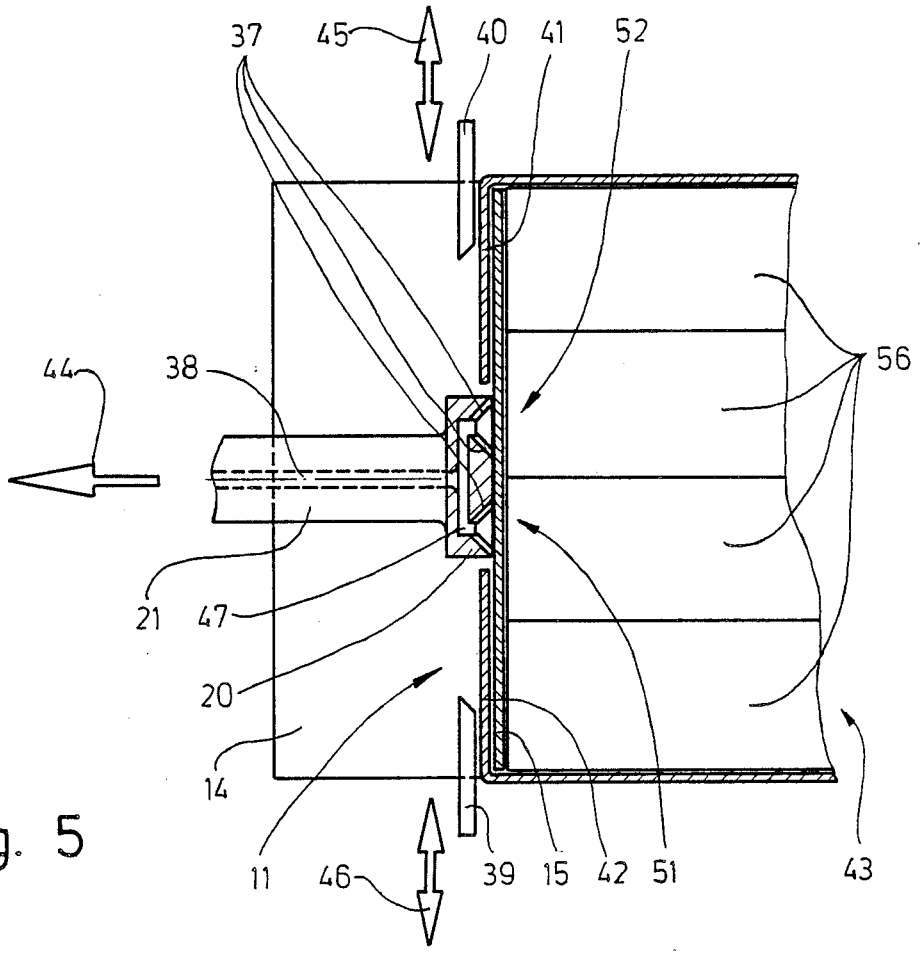

An embodiment of the invention is explained in detail below on the basis of the drawings. Shown are:

FIG. 1 a schematic cross sectional view of a packaging machine for cardboard boxes with insert-transmitters, FIG. 2 a single insert-transmitter in a view as shown FIG. 1, on an enlarged scale, FIG. 3 a representation as shown in FIG. 2, but with the insert-transmitter in an altered position, FIG. 4 a representation as shown in FIGS. 2 and 3, but with the relative position of the insert-transmitter altered again, FIG. 5 a section corresponding to FIG. 4 along line V —V, with the insert-transmitter and a filled cardboard box.

A packaging machine 53, shown here schematically, comprises a conveying track consisting of two carrier bars 54, 55, in parallel alignment. FIG. 1 shows the carrier bars 54, 55 in cross section. The cardboard shells are conveyed on them, vertical to the plane of the projection.

The usual procedure in producing and filling large-volume cardboard boxes is such that a cardboard shell 10, folded together flat and closed in cross section, is filled and closed inside of the packaging machine 53. The cardboard shell 10 is conveyed through the packaging machine 53 in such a way that the open sides 11 and 12, usually top side and bottom of the finished cardboard box, are pointing sideways in relation to the direction of transport of the cardboard shells 10. Furthermore, (upper and lower) folding flaps 13 and 14 on both sides of the cardboard shell 10 also point sideways. The folding flaps 13 and 14 are folded over in the plane of the open sides 11, 12 as soon as the cardboard shell 10 is filled.

Separate, loose, plate-shaped blanks, especially made of cardboard, too, are to be inserted in the open, i.e. partially open, cardboard shell 10. Such inserts 15 can be disposed inside of the finished cardboard box, that is, abutting the cardboard box contents 48, consisting of individual (pasteboard) boxes 56 packed on top of and next to one another. It is possible, alternatively, to attach the inserts 15 after folding over the inner folding flaps 41, 42, but before the outer folding flaps 13, 14 are folded over.

In the present embodiment inserts 15 are to be inserted into both sides of the cardboard box, that is, top and bottom, and therefore on both sides of the cardboard shell 10, before the folding flaps 13, 1; are folded over. For this purpose, insert units 16, 17 are disposed through the whole packaging machine 53, on both sides of the conveying track (carrier bars 54, 55) for the cardboard shell 10.

Each insert unit 16, 17 is composed of a large-volume magazine 18 for receiving a supply of inserts 15, stacked on top of one another. In the present case the magazines 18 are mounted above the moving or conveying track for the cardboard shells 10, that is, in a nearly upright, slightly inclined position (at an acute angle).

The inserts 15 are removed from the magazine from below, moved downwards, set upright, and then inserted into the laterally open cardboard shell 10 by means of transverse movement. An insert-transmitter 19 is provided for this purpose. This transmitter consists of a plate-shaped insert-holder 20, against the outer, i.e. upper side of which an insert 15, respectively, rests. The insert-holder 20 is provided with suction bores 37 which are connected to a vacuum source. Consequently, the inserts 15 are each fixed to the insert-holder 20 by means of suction.

The insert-holder 20 is attached to a supporting arm 21 eccentrically. This arm comprises a hollow channel-shaped feed line 38 (FIGS. 4 and 5) for connecting the insert-holder 20 to the vacuum source. Inside the insert-holder 20 there is a suction channel 47 provided which connects the feed line 38 to the suction bores 37.

The insert-holder 20 has an oblong construction, whereby the suction channel 47 runs along the insert-holder's 20 main direction of extension and has a U-shaped cross section. The suction bores 37 are disposed at the ends 49, 50, respectively, of the suction channel 47. According to FIGS. 1 and 5, eight, namely two times four, suction bores 37 extend from each end 49 or 50, whereby the suction bores 37 of a group of four 51 or 52, diverge radially towards the intaking insert 15.

Alternatively, in an embodiment not shown here, the insert-holder 20 can also be disposed centrically on the supporting arm 21.

The supporting arm 21 is moved by an operating rod 22 in the described manner. The operating rod 22 here consists of two levers, namely double levers 23 and 24 (double-armed levers). These can be swivelled, independently of one another, around a common swivelling axis by means of seating in a common central pivot 25. With this pivot, the double levers 23, 24 are attached to a supporting side wall 26 of the machine frame.

The double levers 23, 24 are constructed as angle levers. The double lever 23 consists of two legs 27, 28, disposed at an obtuse angle to one another, whereas the legs 29, 30 of the double lever 24 point towards one another at an acute angle. Both double levers 23, 24 are, with their ends, hinge-connected to the insert-transmitter 19, i.e. its supporting arm 21. The double lever 24, i.e. its leg 30, is directly connected to a lower part of the supporting arm 21 via a joint 31. The double lever 23 is connected indirectly, namely via a coupling guide rod 32, to the supporting arm 21. The connection of the coupling guide rod 32 to the supporting arm 21 is also effected via a joint 33. Coupling guide rods 32, on the one hand, and legs 30 of the double lever 24, on the other hand, form a parallelogram connection to the supporting arm 21. In order to guarantee the movability of this parallelogram, the coupling guide rod 32 is connected via a joint 34 to the free end of the leg 27.

The operating rod 22, constructed in this way, is driven synchronously with the packaging machine 53. For this purpose, each double lever 23, 24 is assigned an operating means, namely a connecting rod 35, 36, schematically represented here. These rods can be driven via crank mechanism, i e. via cam plates, thus enabling an exact coordination of the movements of the connecting rods 35, 36 to the operating sequence of the packaging machine 53.

The double levers 23, 24 are operated individually by means of the connecting rods 35, 36, that is, swivelled around the central pivot 25. In the case of the relative position of the double levers 23, 24 according to FIG. 2, the insert-transmitter 19 is delivered to the lower insert 15 in the magazine 18. This insert is removed from the magazine 18 in a downward movement (FIGS. 3). Achieved by means of further relative movements of the double levers 23, 24 is that the insert-transmitter 19, i e. its supporting arm 21, executes a swivelling movement, combined with a transverse movement towards the cardboard shell 10. As a result, the insert-holder 20 with the insert 15 is swung to an upright position and introduced into the open side of the cardboard shell 10.

The movements of the insert-transmitter 19 on both sides of the cardboard shell 10, described above, are coordinated so that the feeding of the inserts 15 to the cardboard shell 10 is effected simultaneously.

According to FIG. 5, the interior of the supporting arm 2l comprises a suction channel 47 which is connected to the suction bores 37 in the insert-holder 20.

Insertion of the insert 15 and the subsequent closing of the cardboard box is effected as follows:

The insert 15 is placed inside the open cardboard shell 10 in an upright position by the insert-transmitter 19 and abuts the cardboard box contents 43. Next, inner folding flaps 41, 42 are folded over in a manner which is, as such, well known by means of folding means 39, 40 in the plane of the open side 11. The folding flaps 41, 42 are so short here that they do not butt against the insert-holder 20 situated between them.

The outer folding flaps 13, 14 are not folded inwards until now, whereby simultaneously, the insert-holder 20 with its supporting arm 21 is moved out of the region of the open side 11 in the direction of the arrow 44. The movement of the supporting arm 21 is effected so quickly here that the swivelling of the folding flaps 13, 14 is not impeded by the insert-holder 20. Beforehand, the folding means 39, 40 have already been moved out of the region of the open side 11 of the cardboard shell 10, parallel to the direction of the arrows 45, 46. The folding flaps 13, 14 now cover the insert 15 and the inner folding flaps 41, 42 almost completely.

In another embodiment not shown here, the outer folding flaps 13, 14 again are constructed to be so short that their swivelling movement is not impeded by the insert-holder 20. Therefore, the insert-holder 20 is not released from the insert 15 until after both pairs of folding flaps 41, 42 and 13, 14 have been folded over. This is especially advantageous in the case of cardboard shells 10 which have not yet been filled.

We claim:

1. A packaging machine for cardboard boxes made of a prefabricated blank, folded together flat, which is constructed to form a cardboard shell, polygonal in cross-section and open on two sides, set upright, filled and closed by folding over folding flaps comprising:

a magazine for cardboard inserts (15), at least one of said cardboard inserts at a time being insertable into the open cardboard shell (10);

at least one insert-transmitter (19) comprising an insert-holder (20) for taking a cardboard insert and inserting said cardboard insert in an upright position into said cardboard shell (10), said insert-transmitter (19) being movable by means of an operating rod, wherein said magazine (18) is arranged laterally above a conveying track for said cardboard shells (10), said cardboard inserts being held in said magazine (18), and are individually extractable from said magazine (18), said insert-transmitter (19) including means for extracting a cardboard insert from said magazine (18), pivoting said cardboard insert into an upright position and inserting said cardboard insert into said cardboard shell (10) by means of said insert-holder (20) of said insert transmitter (19) being movable from below via said operating rod to said magazine (18) for extracting said cardboard insert and being lowerable with the extracted cardboard insert, pivotable, and transversely movable in a direction of the open cardboard shell (10) for laterally inserting said cardboard insert.

2. The packaging machine according to claim 1, wherein said insert-transmitter (19) includes means for inserting said cardboard inserts (15) in the laterally open cardboard shells (10) transversely to the conveying direction of the cardboard shells (10).

3. The packaging machine according to claim 2, further comprising two insert units (16, 17) each including an insert-transmitter (19), an insert unit being disposed on each of two sides of a conveying track for cardboard shells (10), said insert units for simultaneously inserting two inserts in two open sides of a cardboard shell.

4. The packaging machine according to claim 1, wherein the operating rod (22) comprises two double-armed levers (23, 24), each of said double-armed levers being fixedly supported and independently pivotable in a common central pivot.

5. The packaging machine according to claim 4, wherein said insert-transmitter further includes a supporting arm (21), and the double-armed levers (23, 24) are connected to said supporting arm (21) so as to form a parallelogram, one of said double-armed levers (24) being connected directly to the supporting arm (21) through one of its legs (30) and the other one of said double-armed levers (23) being connected to the supporting arm (21) via a coupling guide rod (32).

6. The packaging machine according to claim 4 or 5, wherein the double-armed levers (23, 24) comprise angle levers, one double-armed lever (23) comprising two legs (27, 28) pointing towards one another at an obtuse angle and the other one of said double-armed levers (24) comprising two legs (29, 30) pointing towards one another at an acute angle.

7. The packaging machine according to claim 4, further comprising separate actuating means for moving each of said double-armed levers (23, 24), said actuating means comprising connecting rods (35, 36) for moving each double-armed lever (23, 24).

8. The packaging machine according to claim 1, wherein said insert-transmitter further includes a supporting arm (21) said supporting arm (21) includes a feed line (38), and said insert-holder (20), disposed eccentrically at one end of the supporting arm (21), comprises suction bores (37), said suction bores corresponding to said feed line (38) disposed in the supporting arm (21) for detachable fixing of the insert (15) by means of vacuum intake air.

9. The packaging machine according to claim 8, wherein said insert-holder (20) further comprises a suction channel (47) extending essentially perpendicularly to the feed line (38), and the suction bores (37) are connected to the feed line (38) via said suction channel (47).

10. The packaging machine according to claim 9, wherein the suction bores (37) are disposed at ends (49, 50) of the suction channel (47), respectively, and are a predetermined distance apart from each other and said cardboard insert (15) being fixable to said insert-holder (20) by more than one suction bore (37).

11. A process for packaging articles in cardboard boxes, closeable at least on one side by means of folding flaps, for use in a packaging machine according to claim 1, the process comprising the steps of:

inserting a cardboard insert (15) into an open side (11) of the cardboard shell (10) by means of an insert-transmitter (19); and folding the folding flaps (13, 14, 41, 42) in the plane of the open side (11).

12. The process according to claim 11, characterized in that after said inserting step, the process further comprises the step of:

holding the cardboard insert (15) inside the cardboard box (10); and wherein said folding step comprises the steps of:

folding a pair of inner folding flaps (41, 42) and folding a pair of outer folding flaps (13, 14) in the plane of the open side (11), while simultaneously, detaching and removing the insert-transmitter (19) from the cardboard insert (15).

* * * * *